US006636138B2

(12) United States Patent
Bernardi et al.

(10) Patent No.: US 6,636,138 B2
(45) Date of Patent: Oct. 21, 2003

(54) IGNITION COIL FOR MOTOR VEHICLES

(75) Inventors: Giorgio Bernardi, Modena (IT); Graziano Gualdi, Soliera (IT); Roberto Righi, Modena (IT)

(73) Assignee: Federal-Mogul Ignition Srl, Milan (IT)

( * ) Notice: Subject to any disclaimer, the term of this patent is extended or adjusted under 35 U.S.C. 154(b) by 0 days.

(21) Appl. No.: 09/872,370

(22) Filed: Jun. 1, 2001

(65) Prior Publication Data

US 2001/0050604 A1 Dec. 13, 2001

(30) Foreign Application Priority Data

Jun. 6, 2000 (EP) ..... 00830405

(51) Int. Cl.[7] ..... H01F 27/02

(52) U.S. Cl. ..... 336/90; 336/198; 336/96; 123/634

(58) Field of Search ..... 336/90, 198, 96; 123/634

(56) References Cited

U.S. PATENT DOCUMENTS

2002/0057179 A1 * 5/2002 Shimada et al. ..... 336/208

FOREIGN PATENT DOCUMENTS

| | | | |
|---|---|---|---|
| DE | 44 24 161 A | | 1/1995 |
| DE | 196 23 399 A | | 1/1998 |
| EP | 0638971 A1 | * | 2/1995 |
| GB | 2252454 A | * | 5/1992 |
| GB | 2 252 454 A | | 8/1992 |

* cited by examiner

*Primary Examiner*—Elvin Enad
*Assistant Examiner*—Jennifer A. Poker
(74) *Attorney, Agent, or Firm*—Reising, Ethington, Barnes, Kisselle, P.C.

(57) ABSTRACT

An ignition coil for a motor vehicle, comprising: a magnetic core (12) having an elongated shape, a primary spool (20) supporting a low-voltage winding (22), and a secondary spool (16) supporting a high-voltage winding (18). The two spools are set coaxially with respect to the magnetic core. The coil includes a tubular shaped outer casing (24) carrying, at a first end, a low-voltage connector (28) and, at a second end, a high-voltage connector (30) which is designed to connect with a spark plug. A diode (42) is set at one end of the high-voltage spool (16) and has both a first rheophore (44), which is electrically connected to one end of the high-voltage winding (18), and a second rheophore (46), which is electrically connected to the high-voltage connector (30). The coil includes a diode-supporting member (48) which is equipped with anchoring elements (58, 60) for retaining the diode (42) to the end of the secondary spool (16) by bending each of the rheophores (44, 46) around one of the anchoring portions (58, 60).

9 Claims, 2 Drawing Sheets

IGNITION COIL FOR MOTOR VEHICLES

TECHNICAL FIELD

The present invention relates to an ignition coil for internal-combustion engines with spark ignition for motor vehicles. In particular, the invention relates to an ignition coil as specified in the preamble of claim 1.

BACKGROUND OF THE INVENTION

Ignition coils for motor vehicles are known that have an elongated shape and are designed to be mounted directly on the end of a corresponding spark plug.

A known ignition coil of this type comprises a magnetic core having an elongated shape, a primary spool supporting a low-voltage winding, and a secondary spool supporting a high-voltage winding. The primary spool, secondary spool, and magnetic core are coaxial with each other and are inserted inside a tubular casing having an elongated shape which carries, at one first end, a low-voltage connector, and at one second end a high-voltage connector that is designed to connect with a spark plug.

Ignition coils of this type are normally equipped with a diode having a first rheophore electrically connected to one end of the high-voltage winding, and a second rheophore electrically connected to the high-voltage connector of the ignition coil. Mechanical connection of the diode to the other components of the ignition coil generally represents a delicate part of the process of assembling an ignition coil. In traditional solutions, also electrical connection between the rheophore of the diode and the high-voltage connector is somewhat problematical.

SUMMARY OF THE INVENTION

The object of the present invention is to improve on an ignition coil of the type specified above in such a way as to overcome the drawbacks of known solutions.

According to the present invention, the aforesaid object is achieved by an ignition coil having the characteristics specified in claim 1.

BRIEF DESCRIPTION OF THE DRAWINGS

The present invention will now be described in detail with reference to the attached drawings, which are provided purely to furnish a non-limiting example, and in which.

DETAILED DESCRIPTION OF THE PREFERRED EMBODIMENT

Figure 1:
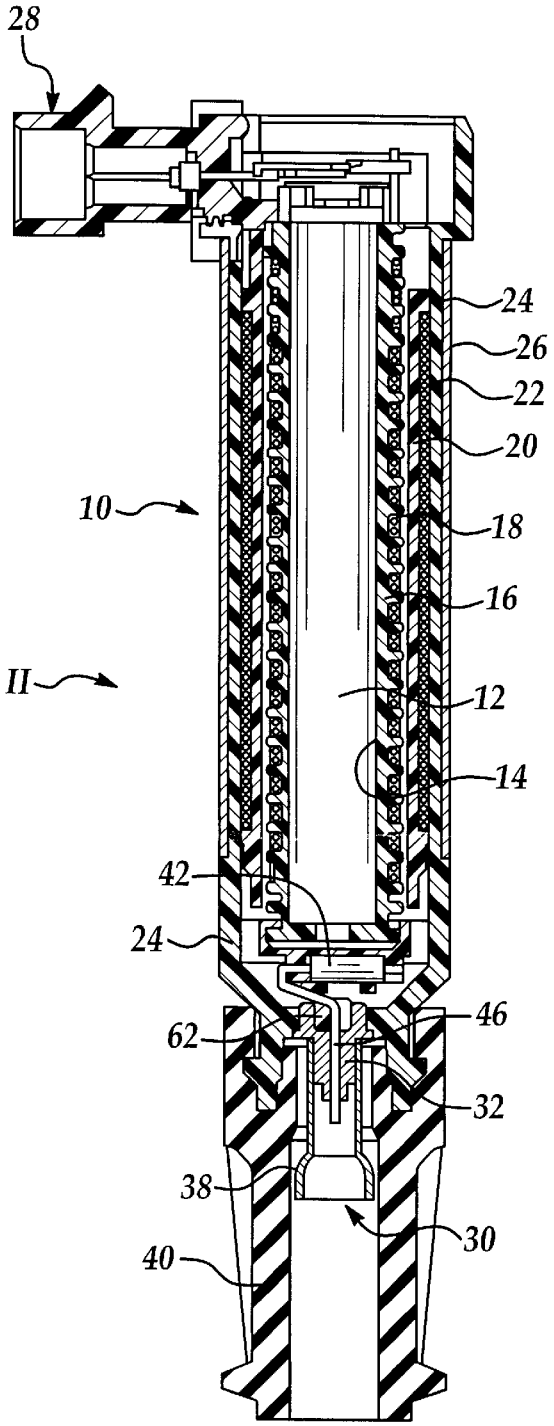
FIG. 1 is an axial sectional view of an ignition coil according to the present invention.
Figure 2:
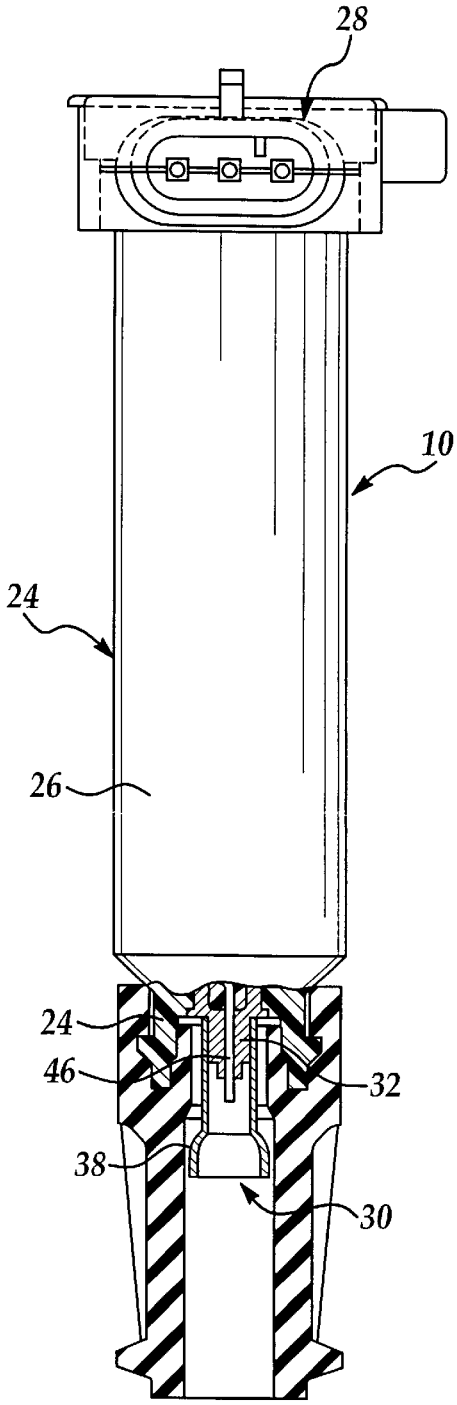
FIG. 2 is a side elevation, partially sectioned, according to the arrow II of FIG. 1.

With reference to FIGS. 1 and 2, the number 10 designates an ignition coil for internal-combustion engines with spark ignition for motor vehicles. The ignition coil 10 comprises a magnetic core 12 which consists, in a way in itself known, of a stack of laminations made of a material with high magnetic permeability. The laminated magnetic core 12 is shaped like an elongated cylinder and is housed inside a cylindrical cavity 14 of a secondary spool 16, on which a high-voltage winding 18 is wound. The secondary spool 16 is in turn set inside a primary spool 20 carrying a low-voltage winding 22. The assembly including the primary spool 20, the secondary spool 16, and the magnetic core 12 is inserted in an outer casing 24, on the external surface of which are wrapped one or more sheets 26 made of metal material in such a way as to form a sheath by means of which the magnetic flux is enclosed.

After assembly of the various components of the ignition coil inside the outer casing 24, in a way in itself known the said casing is filled with an insulating resin, for example an epoxy-type resin.

Figure 3:
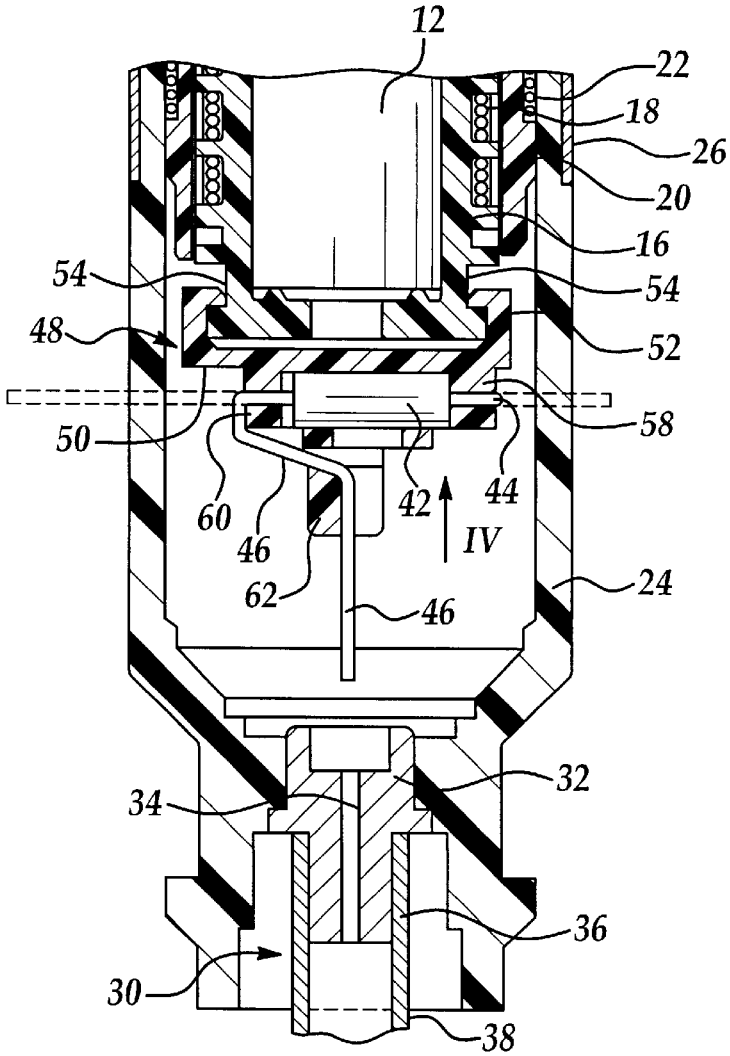
FIG. 3 is a partially exploded axial sectional view of the part indicated by the arrow III in FIG. 1.

The ignition coil 10 comprises a low-voltage connector 28 and a high-voltage connector 30 set at opposite ends of the tubular casing 24. With reference to FIGS. 1, 2 and 3, the high-voltage connector 30 comprises a metal terminal 32 fixed, in a central position, to one end of the outer casing 24. The terminal 32 has a through hole 34 which extends along the longitudinal axis of the ignition coil, and a protruding portion 36 on which a metal connecting element 38 is fixed, which is designed to establish a mechanical and electrical connection with the top end of a spark plug (not illustrated) for motor vehicles. In a way of itself known, an elastic cap 40 made of elastomeric material or the like is applied to the end of the tubular casing 24. The cap 40 surrounds the connecting element 30 and has a tubular part which fits on the stem of the spark plug.

With reference to FIGS. 1 and 3, the secondary spool 16 has one bottom end which protrudes beyond the corresponding end of the primary coil 20. At the bottom end of the secondary coil 16 is set a diode 42 which has a first rheophore 44 connected to one end of the high-voltage winding 18, and a second rheophore 46 connected to the high-voltage connector 30.

Figure 4:
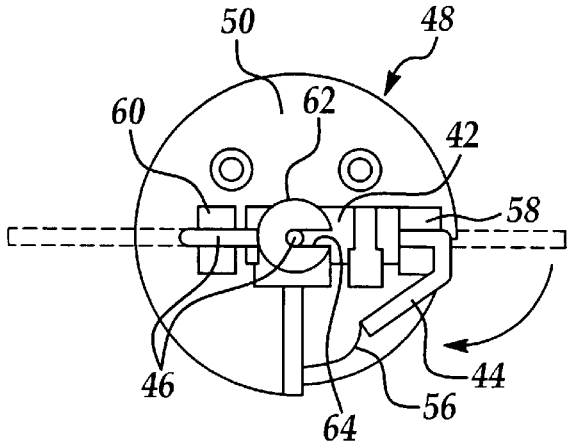
FIG. 4 is a view according to the arrow IV of FIG. 3.

With particular reference to FIGS. 3 and 4, the diode 42 is carried by a supporting member 48 made of injection-moulded plastic material. The diode-supporting member 48 has a disk-shaped base 50 provided with integral teeth 52 which snap-engage an annular seat 54 formed on the end portion of the secondary coil 16. In undeformed conditions, the rheophores 44, 46 of the diode 42 are two rectilinear metal elements which protrude from opposite sides of the diode, as indicated by the dashed lines in FIG. 4.

The rheophore 44 is bent in a plane parallel to the base 50 against one part 56 of the base 50 having a reduced diameter. The rheophore 44 is also bent around an anchoring element 58 formed as a single piece with the base 50. The bending of the rheophore 44 against the portion of reduced diameter 56 has the dual purpose of supplying an anchorage for the diode 42 to the base 50 and of keeping the rheophore radially away from the outer surface of the ignition coil, thus reducing the risk of electrical discharges between the secondary winding and the external environment (spark-plug well).

The second rheophore 46 is bent in a plane orthogonal to the plane of the base 50 around a second anchoring element 60 formed as a single piece with the base 50. The anchorage of the rheophores 44 and 46 around the anchoring elements 58, 60 makes it possible to fix the diode 42 in a stable way to the supporting member 48. Preferably, the supporting member 48 has an arm 62 made of a single piece with a seat 64 which withholds a rectilinear end stretch of the rheophore 46 in a rectilinear position parallel to the axis of the ignition coil. As may be seen from FIG. 3, the arm 62 keeps the end stretch of the rheophore 46 aligned to the hole 34 of the metal terminal 32 in such a way as to facilitate insertion of the rheophore 46 inside the hole 34. The arm 62 could be eliminated, and in this case the top part of the hole 34 could communicate with a tapered portion providing a lead-in having the purpose of facilitating insertion of the rheophore 46 in the hole 34. After inserting of the rheophore in the respective hole 34, the metal terminal 32 is plastically deformed in a radial direction against the rheophore 46 in order to guarantee electrical continuity and sealing during the process of pouring of the resin. The diode-supporting member 48 facilitates the process of assembly of the induction coil, guaranteeing the radial centering and the longitudinal positioning of the spools 16, 20 and of the magnetic core 12 with respect to the outer casing 24 and between one another, thus guaranteeing uniformity of performance and reducing the risk of electrical discharges between the windings or towards the outside of the induction coil, caused by the reduction of the thickness of insulating material due to the possible misalignment between the components of the induction coil. The crimping of the high-voltage terminal 32 on the rheophore of the diode guarantees the seal and electrical contact, so preventing the need for additional and more complex operations (for example, soldering) and the use of additional soldering material, with the result that the production process is facilitated and the corresponding costs are reduced.

What is claimed is:

1. An ignition coil for motor vehicles, comprising:

a magnetic core (12) having an elongated shape;

a primary spool (20) supporting a low-voltage winding (22), and a secondary spool (16) supporting a high-voltage winding (18), the two spools being set coaxially with respect to the magnetic core;

a tubular-shaped outer casing (24) carrying, at a first end, a low-voltage connector (28) and, at a second end, a high-voltage connector (30) which is designed to connect with a spark plug; and a diode (42) set at one end off the high-voltage spool (16) and having a first rheophore (44) which is electrically connected to one end of the high-voltage winding (18), and a second rheophore (46) which is electrically connected to the high-voltage connector (30);

characterized in that it comprises a diode-supporting member (48) attached at the one end of the secondary spool, the diode-supporting member including one or more anchoring elements against which at least one of the rheophores are bent to fix the diode in place on the diode-supporting member.

2. An ignition coil as per claim 1, characterized in that the one or more anchoring elements are made of a single piece with the diode-supporting member.

3. An ignition coil for motor vehicles, comprising:

a magnetic core (12) having an elongated shape;

a primary spool (20) supporting a low-voltage winding (22), and a secondary spool (16) supporting a high-voltage winding (18), the two spools being set coaxially with respect to the magnetic core;

a tubular-shaped outer casing (24) carrying, at a first end, a low-voltage connector (28) and, at a second end, a high-voltage connector (30) which is designed to connect with a spark plug; and a diode (42) set at one end of the high-voltage spool (16) and having a rheophore (44) which is electrically connected to one end of the high-voltage winding (18), and a second rheophore (46) which is electrically connected to the high-voltage connector (30);

characterized in that it comprises a diode-supporting member (48) which is equipped with means (58, 60) for retaining the diode (42) and with means (52) for snap-connection to the end of the secondary spool;

characterized in that the aforesaid first rheophore (44) is bent against one portion (56) with a reduced diameter of a disk-shaped base (50) of the diode supporting member (48).

4. An ignition coil as per claim 1, characterized in that the diode-supporting member (48) has an integral arm (62) having a seat in contact with a rectilinear portion of the second rheophore.

5. An ignition coil as per claim 1, further comprising a metal terminal (32), characterized in that the second rheophore (46) includes a rectilinear portion that is inserted into a hole (34) of the metal terminal (32) and that is connected to the metal terminal by plastic deformation in a radial direction of a tubular portion (36) of the metal terminal against the rheophore (46).

6. An ignition coil as per claim 4, wherein the primary and secondary spools are disposed coaxially about a longitudinal axis and wherein the rectilinear portion extends in a direction parallel to the longitudinal axis.

7. An ignition coil as per claim 1, wherein the diode-supporting member includes a base having a reduced diameter portion that comprises one of the one or more anchoring elements, with the first rheophore being bent around the reduced diameter portion.

8. An ignition coil as per claim 1, wherein the one or more anchoring portions comprise two or more anchoring elements.

9. An ignition coil as per claim 1, wherein the diode-supporting member has integral teeth for snap connection of the diode-supporting member to the end of the secondary spool.

* * * * *